United States Patent [19]

Crist, Jr.

[11] Patent Number: 4,557,772

[45] Date of Patent: Dec. 10, 1985

[54] PROCESS FOR MAKING STAINED GLASS TIFFANY-TYPE LAMP SHADES

[76] Inventor: Paul V. Crist, Jr., 4941 N. Camellia Ave., Temple City, Calif. 91780

[21] Appl. No.: 651,991

[22] Filed: Sep. 19, 1984

[51] Int. Cl.[4] ..... B44C 3/12

[52] U.S. Cl. ..... 156/62; 156/63; 156/299; 156/326; 362/361; 428/38

[58] Field of Search ..... 156/62, 63, 299, 326; 428/38; 362/361

[56] References Cited

U.S. PATENT DOCUMENTS

| | | | |
|---|---|---|---|
| 3,420,728 | 1/1969 | Haverstock | 156/63 X |
| 3,872,574 | 3/1975 | Worden | 428/38 X |
| 4,009,309 | 2/1977 | Holt | 428/38 |
| 4,110,393 | 8/1978 | Trame | 428/38 X |
| 4,302,260 | 11/1981 | Meltzer | 156/63 |
| 4,312,688 | 1/1982 | Brodis et al. | 156/63 |
| 4,452,839 | 6/1984 | Worden | 156/63 X |

FOREIGN PATENT DOCUMENTS

| | | | |
|---|---|---|---|
| 1596784 | 7/1970 | France | 156/62 |

*Primary Examiner*—Robert A. Dawson
*Attorney, Agent, or Firm*—Keith D. Beecher

[57] ABSTRACT

A process for making stained glass Tiffany-type lamp shades which comprises providing a kit containing an inscribed fiberglass form, a pressure-sensitive wax adhesive for attaching shaped pieces of different sized stained glass to the form in correspondingly shaped and sized circumscribed areas on the surface of the form, and a print on which a particular design is imprinted corresponding to the circumscribed areas on the form, and which may be cut out into patterns to be used to cut stained glass of different colors into pieces to conform to the various shapes and sizes to be incorporated into the design. A transparency is also provided on which the entire design is reproduced to slightly expanded size as opaque lines on a transparent medium. The transparency is placed over a light box, and each cut stained glass piece is placed in its corresponding position on the transparency as a preview to aid in the color selection of the stained glass pieces.

18 Claims, 4 Drawing Figures

PROCESS FOR MAKING STAINED GLASS TIFFANY-TYPE LAMP SHADES

BACKGROUND OF THE INVENTION

Tiffany glass lamp shades are well known and traditionally include a fine mosaic of stained glass patterned portions separated from one another by leaded portions. The lamp shades are particularly beautiful and the original forms produced by Tiffany exhibit especially attractive color effects.

The traditional method for fabricating Tiffany lamp shades included providing a wooden form conforming to the shape of the lamp shade. A thin paper or linen is then adhesively attached to the form, conforming to the curved surface of the form, and the artist then makes a line drawing of the desired design. The lines of the drawing defined a multiplicity of areas of different sizes and shapes in which correspondingly sized and shaped pieces of stained glass are to occupy in the completed design.

The paper or linen is then stripped off the form, cut apart along enough of the pattern lines to lay flat, and the various areas are numbered. A copy is made by tracing and is then reproduced and copies used for reference purposes. The original copy is cut into patterns to be used in cutting different colored pieces of stained glass into corresponding shapes and sizes. The surface of the form is then coated with an appropriate pressure-sensitive adhesive wax, and the glass pieces are then adhesively attached to the surface of the form using the copy of the drawing as a reference.

The stained glass pieces are then independently removed from the form, framed with adhesive-backed copper foil, and then replaced. The pieces are then soldered together using the copper foil as a base for the solder.

The form is then heated to a temperature sufficient to melt the adhesive wax so as to permit the resulting lamp shade to be lifted off the form. The soldering process is then repeated for the interior of the lamp shade. Upper and lower metal rims are then soldered to the assembly. The lamp shade may then be finished by electroplating copper over the solder surfaces, and by patinating the resulting copper surfaces.

It is an objective of the present invention to provide an improved method for making Tiffany-type lamp shades as compared with the traditional method described above, and to provide a kit to enable such lamp shades to be made with relative ease and without the need for any special skills or special artistic talent.

DETAILED DESCRIPTION OF THE PREFERRED EMBODIMENT OF THE PROCESS OF THE INVENTION

Figure 1:
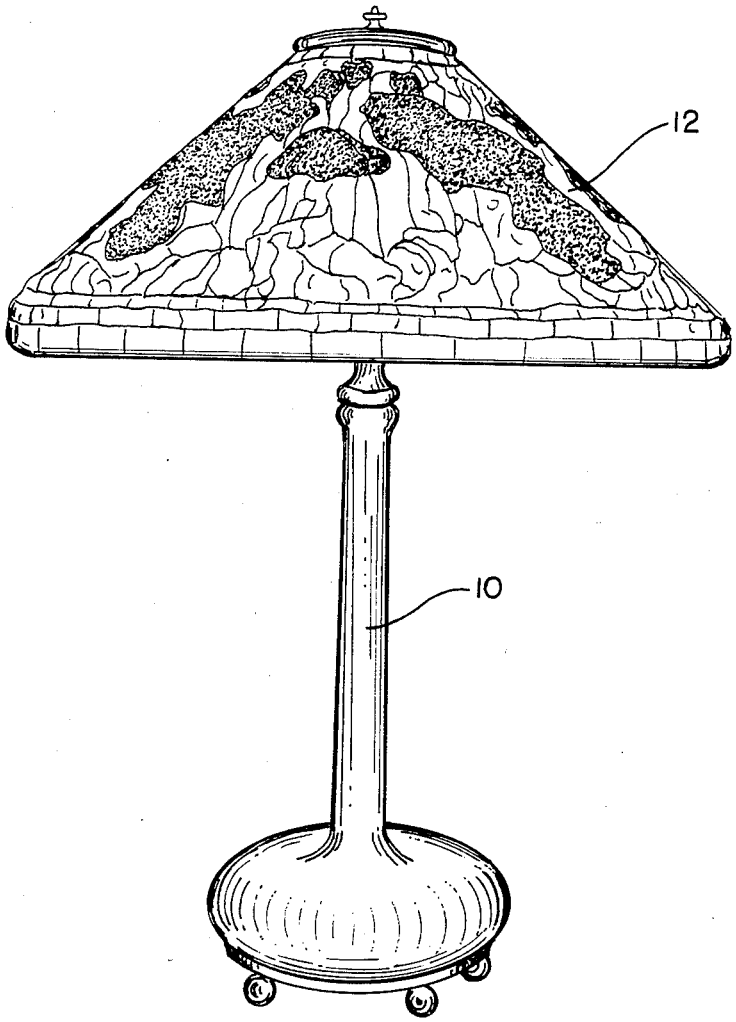
FIG. 1 is a representation of a typical Tiffany-type lamp, incorporating a lamp shade that may be fabricated in accordance with the process of the present invention.

The lamp shown in FIG. 1 is a typical Tiffany lamp having a base 10 and a lamp shade 12. The lamp shade is composed of a multiplicity of pieces of stained glass of different colors, shapes and sizes, representing a floral design.

As mentioned above, the process of the present invention provides a simplified method for fabricating Tiffany-type lamp shades of the type shown in FIG. 1, without the need for undue skill or artistic talent.

Figure 2:
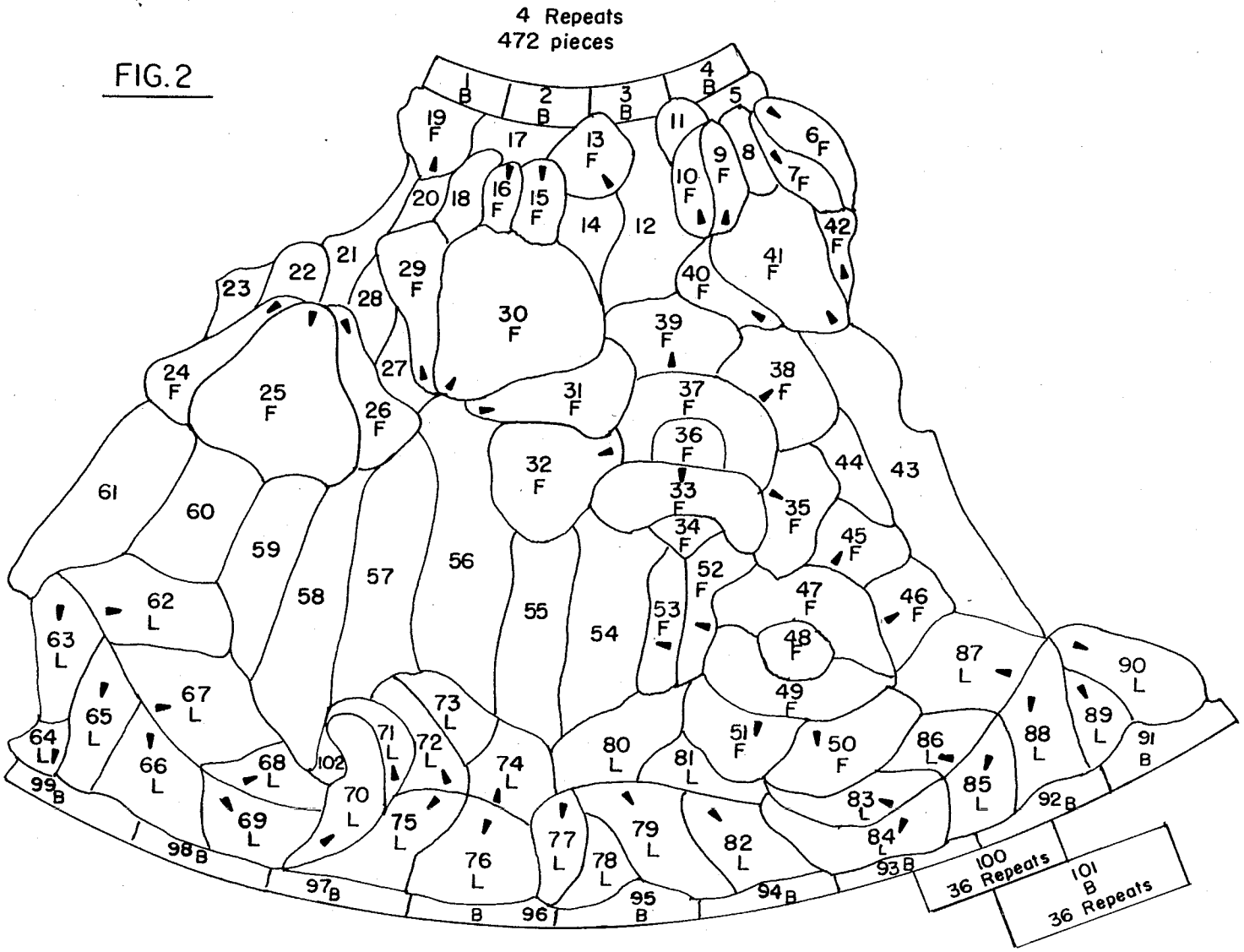
FIG. 2 is a representation of a print of a lined drawing representing a portion of the design to be incorporated into the lamp shade to be fabricated by the process.

As also mentioned above, kits may be provided for practicing the process of the invention, and each kit may include, for example, two prints of the type shown in FIG. 2. The prints are reproductions of a line drawing of the particular design to be incorporated into the lamp shade. In most instances the design is repeated several times around the lamp shade. In the case of the print of FIG. 2, for example, the design is repeated four times. Accordingly, the print represents one-quarter of the entire design, and is repeated four times around the lamp shade.

In the particular design of FIG. 2, each circumscribed area is given a number. Also, certain areas are designated "F" to indicate flowers, certain areas are designated "L" to indicate leaves, and certain areas are designated "B" to indicate borders. The unlettered areas are all part of the background.

As stated above, two prints such as the one shown in FIG. 2 are provided in the kit. One of the prints is used as a reference, and the other is cut up and the resulting pieces used as patterns for cutting corresponding pieces of stained glass. In the particular design of FIG. 2, four pieces of stained glass are cut to correspond to each pattern, because the segment of FIG. 2 is repeated four times around the completed lamp shade.

A transparency 20 is also provided which may be included in the kit and which contains a lined representation of the entire design, that is, four of the segments of FIG. 2. The lines on the transparency are opaque, and the circumscribed areas are transparent. The design on the transparency corresponds to the exact size of the design to appear on the lamp shade. The transparency may be a photographic negative, with a transparent Mylar substrate, or it may be produced by the diazo process. Alternately, the substrate may be a clear acetate with heavy opaque lines, or any other appropriate construction.

The transparency 20 is taped to a transparent sheet of glass and laid down upon a light box 22. Then each piece of stained glass that has been cut in accordance with the steps of the process described above is set in its corresponding area on the transparency. This provides an opportunity for the designer to replace any of the stained glass pieces which may have an unacceptable color, or shading.

A fiberglass form 50 (FIG. 4) is also provided in the kit. The outer surface of the form conforms with the shape and size of the inner surface of the lamp shade to be fabricated. The outer surface of the form is inscribed with lines which circumscribe areas conforming with the areas of the print of FIG. 2, repeated four times around the surface of the form. The fiberglass form includes a recessed disc shaped cavity 54 in the top of the form for proper placement and levelling of the upper ring of the lamp shade; and it also may include a ledge 52 above its lower peripheral edge to insure a level lower edge for the lamp shade.

The exterior surface of form 50 is then coated with an appropriate pressure-sensitive adhesive wax. A suitable wax for this purpose is a microcrystalline based wax developed for graphic art layouts, and is known as "paste-up" wax. Such wax is sold in solid form by the Addressograph-Multigraph Corporation under the name "Verityper Wax". In the process of the present invention, the wax is melted and brushed over the surface of the form 50.

Figure 3:
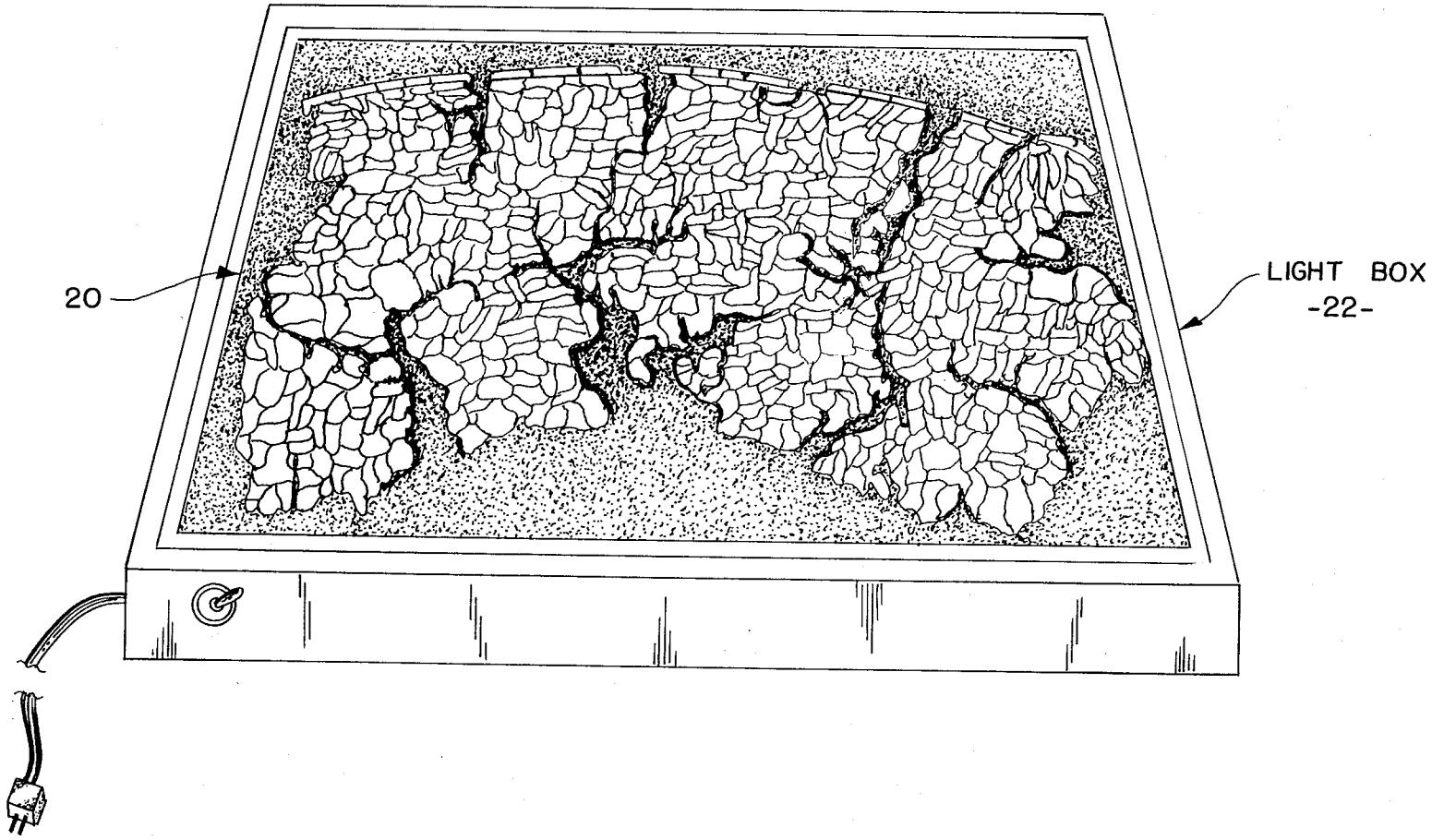
FIG. 3 is a perspective representation of a transparency representing the entire design, or a portion of the design, to be formed by the process, and showing the transparency on a light box which serves to illuminate the design.
Figure 4:
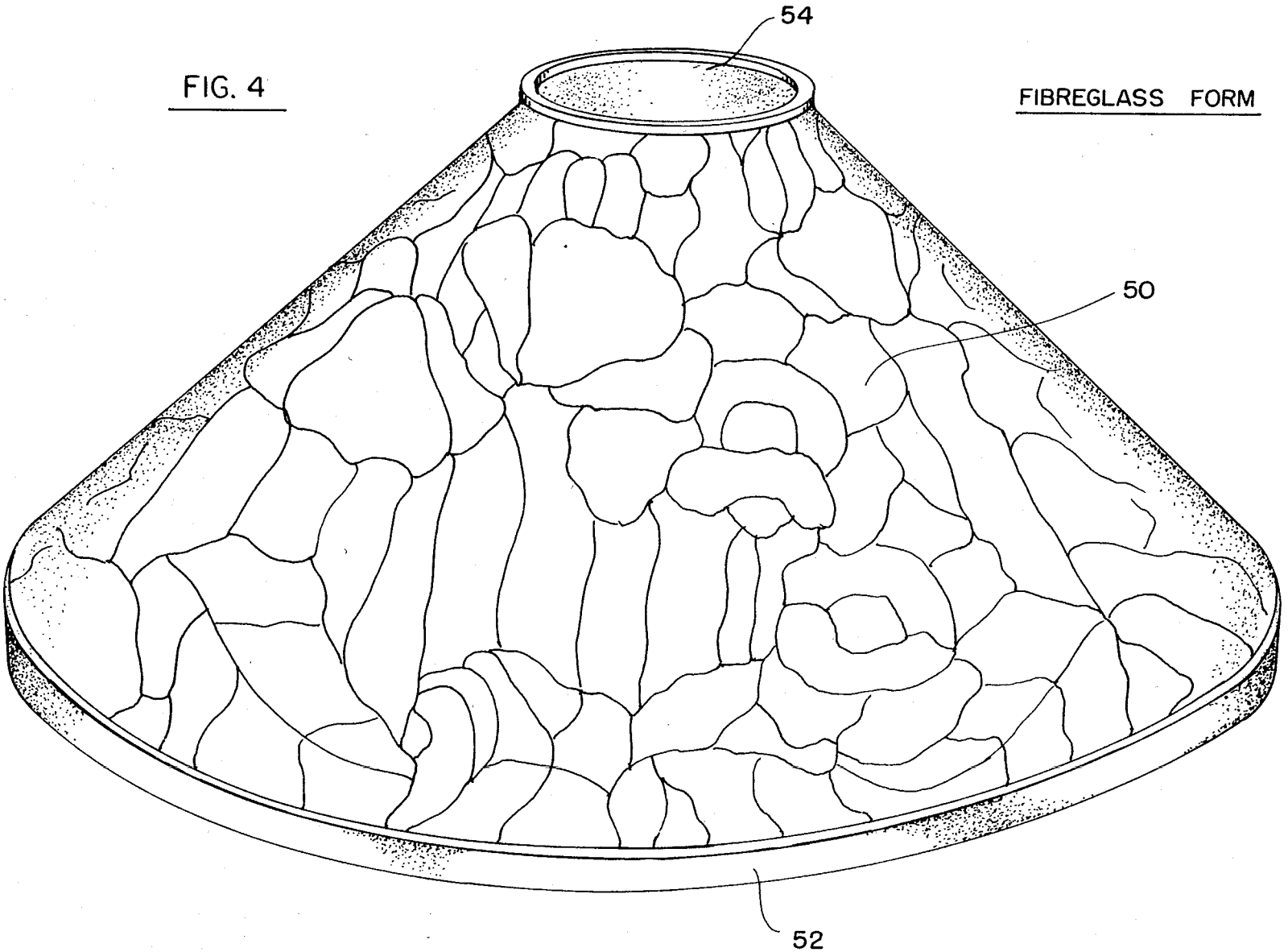
FIG. 4 is a perspective view of a fiberglass form which is used in carrying out the process.

Then, each piece of glass is lifted from the transparency of FIG. 3, and placed in its proper inscribed area on the form 50 of FIG. 4, at which time any necessary trimming is done. The duplicate copy of the print of FIG. 2 may be used as a reference for this step of the process. After all the glass pieces have been placed on the form, each piece is removed individually, framed with a strip of pressure-sensitive adhesive-backed copper foil, and replaced on the form.

After all of the glass pieces on the form 50 have been foiled and replaced, they are soldered together, and the upper ring is placed in recess 54 and soldered to the adjacent glass pieces. The form is then heated to melt the wax, and the stained glass unit is removed from the form. The soldering operation is then repeated on the interior surface of the structure, and the lower rim is soldered in place.

The assembly is then subjected to an electroplating process, by which copper is electroplated over all the exposed soldered surfaces. The resulting exposed copper surfaces are then patinated.

The fiberglass frame 50 is fabricated by usual fiberglass molding techniques. First a wood mold is provided of the desired shape and size, and a fiberglass working form is produced from the wood mold. Lines are then inscribed on the surface of the working form to provide a lined representation of the design of FIG. 2, repeated four times around the surface of the form. A second mold is made from the working form whose surface has raised lines corresponding to the inscribed lines of the working form. The forms 50 are then produced on a mass production basis from the second mold, with the surfaces of the resulting forms containing the desired inscribed lines.

The print of FIG. 2 is formed by inscribing opaque lines by hand on a transparent Mylar substrate corresponding to the design. The resulting circumscribed areas are then numbered and lettered. Prints, such as shown in FIG. 2, may then be produced by photographic, or diazo means, or by other reproducing methods, on a mass production basis.

The invention provides, therefore, a simplified process for fabricating Tiffany-type lamp shades which may be practiced by persons without undue skill or artistic talent.

It will be appreciated that while a particular embodiment of the invention has been shown and described, modifications may be made. It is intended in the claims to cover all modifications which come within the true spirit and scope of the invention.

I claim:

1. A process for making a stained glass lamp shade of a particular design which comprises the following steps: (a) providing a lined drawing of at least a portion of the design to be incorporated into the lamp shade which incorporates circumscribed areas representing the sizes and shapes of pieces of stained glass required to form the design; (b) cutting the lined drawing into separate patterns respectively representing the size and shapes said pieces of stained glass; (c) providing a quantity of stained glass of different colors; (d) cutting the stained glass into selected sizes and shapes by means of said patterns to obtain the required pieces of stained glass to form the design; (e) providing a form corresponding to the shape of the lamp shade to be produced by the process; (f) inscribing lines on the outer surface of the form circumscribing areas corresponding in size and shape to the circumscribed areas of the lined drawing; (g) adhesively attaching the pieces of stained glass to the external surface of the form in respective ones of the circumscribed areas thereon; and (h) attaching the pieces of stained glass to one another.

2. The process defined in claim 1, in which the form is formed of fiberglass.

3. The process defined in claim 2, and which includes the step of coating a pressure-sensitive microcrystalline based adhesive wax to the external surface of the form adhesively to retain the pieces of stained glass on the form.

4. The process defined in claim 1, and which comprises providing a second identical lined drawing for reference purposes.

5. The process defined in claim 1, and which includes the step of numbering the circumscribed areas of the lined drawing.

6. The process defined in claim 4, and which includes the step of numbering the circumscribed areas of the lined drawing.

7. The process defined in claim 1, and which includes the step of providing a supporting ridge around the lower peripheral edge of the form.

8. The process defined in claim 1, and which includes the step of providing a recessed disc-shaped cavity in the top of the form.

9. The process defined in claim 1, and which includes the steps of providing a transparency having opaque lines thereon inscribing areas conforming to the size and shape of the circumscribed areas of the lined drawing; placing the transparency over a light box; and placing the pieces of stained glass obtained by step (d) in corresponding circumscribed areas on the transparency to provide a preview of the pieces as they subsequently would appear on the lamp shade.

10. A process for making a stained glass lamp shade of a particular design which comprises the following steps: (a) providing a lined drawing of at least a portion of the design to be incorporated into the lamp shade which incorporates circumscribed areas representing the sizes and shapes of pieces of stained glass required to form the design; (b) cutting the lined drawing into separate patterns respectively representing the size and shapes said pieces of stained glass; (c) providing a quantity of stained glass of different colors; (d) cutting the stained glass into selected sizes and shapes by means of said patterns to obtain the required pieces of stained glass to form the design; (e) providing a form corresponding to the shape of the lamp shade to be produced by the process; (f) providing a supporting ridge around the lower peripheral edge of the form; and (g) adhesively attaching the pieces of stained glass obtained by step (d) to the external surface of the form.

11. A process for making a stained glass lamp shade of a particular design which includes the following steps: (a) providing a form corresponding to the shape of the lamp shade to be formed by the process; (b) inscribing lines on the outer surface of the form to provide circumscribed areas of selected sizes and shapes; (c) providing a quantity of stained glass pieces of different shapes, sizes and colors respectively corresponding in size and shape to the circumscribed areas on the form; and (d) adhesively attaching the pieces of stained glass to the external surface of the form in respective ones of the circumscribed areas therein.

12. A process for making a stained glass lamp shade of a particular design which includes the following steps: (a) providing a form corresponding to the shape of the lamp shade to be formed by the process; (b) inscribing lines on the outer surface of the form to provide circumscribed areas of selected sizes and shapes; (c) providing a quantity of stained glass pieces of different shapes, sizes and colors respectively corresponding in size and shape to the circumscribed areas on the form; (d) adhesively attaching the pieces of stained glass to the external surface of the form in respective ones of the circumscribed areas therein, and in which the form is composed of fiberglass.

13. A process for making a stained glass lamp shade of a particular design which includes the following steps: (a) providing a form corresponding to the shape of the lamp shade to be formed by the process; (b) inscribing lines on the outer surface of the form to provide circumscribed areas of selected sizes and shapes; (c) providing a quantity of stained glass pieces of different shapes, sizes and colors respectively corresponding in size and shape to the circumscribed areas on the form; (d) adhesively attaching the pieces of stained glass to the external surface of the form in respective ones of the circumscribed areas therein, and which includes the step of providing a supporting ridge around the lower peripheral edge of the form.

14. A process for making a stained glass lamp shade of a particular design which includes the following steps: (a) providing a form corresponding to the shape of the lamp shade to be formed by the process; (b) inscribing lines on the outer surface of the form to provide circumscribed areas of selected sizes and shapes; (c) providing a quantity of stained glass pieces of different shapes, sizes and colors respectively corresponding in size and shape to the circumscribed areas on the form; (d) adhesively attaching the pieces of stained glass to the external surface of the form in respective ones of the circumscribed areas therein, and which includes the step of providing a recessed disc-shaped cavity in the top of the form.

15. A process for making a stained glass lamp shade of a particular design which includes the following steps: (a) providing a form corresponding to the shape of the lamp shade to be formed by the process; (b) inscribing lines on the outer surface of the form to provide circumscribed areas of selected sizes and shapes; (c) providing a quantity of stained glass pieces of different shapes, sizes and colors respectively corresponding in size and shape to the circumscribed areas on the form; (d) adhesively attaching the pieces of stained glass to the external surface of the form in respective ones of the circumscribed areas therein, and which includes the step of applying a coating of pressure-sensitive microcrystalline based wax to the external surface of the form adhesively to attach the pieces of stained glass to the form.

16. A process for making a stained glass lamp shade of a particular design which comprises the following steps: (a) providing a form corresponding to the shape of the lamp shade to be fabricated; (b) providing a quantity of pieces of stained glass of different sizes, shapes and colors to constitute the particular design; (c) providing a transparency having opaque lines thereon circumscribing areas of the size and shape of the design to appear on the lamp shade; (d) placing the transparency over a light box; (e) placing the pieces of stained glass in corresponding areas on the transparency to provide a pre-examination of the pieces to permit replacement and trimming of the pieces; and (f) removing the pieces from the transparency and adhesively attaching the pieces to the form.

17. A process for making a stained glass lamp shade of a particular design which comprises the following steps: (a) providing a lined drawing of at least a portion of the design to be incorporated into the lamp shade which incorporates circumscribed areas representing the sizes and shapes of pieces of stained glass required to form the design; (b) cutting the lined drawing into separate patterns respectively representing the size and shapes said pieces of stained glass; (c) providing a quantity of stained glass of different colors; (d) cutting the stained glass into selected sizes and shapes by means of said patterns to obtain the required pieces of stained glass to form the design; (e) providing a form corresponding to the shape of the lamp shade to be produced by the process; (f) coating a pressure-sensitive microcrystalline based adhesive wax to the external surface of the form; (g) placing the pieces of stained glass on the wax coating; and (h) attaching the pieces of stained glass to one another.

18. A process for making a stained glass product which comprises the following steps: (a) providing a form corresponding to the shape of the product to be fabricated; (b) providing a quantity of pieces of stained glass; (c) coating a pressure-sensitive microcrystalline based adhesive wax to the external surface of the form; (d) placing the pieces of stained glass on the wax coating; and (e) attaching the pieces of stained glass to one another.

* * * * *